US009981816B2

(12) United States Patent
Omichi et al.

(10) Patent No.: US 9,981,816 B2
(45) Date of Patent: May 29, 2018

(54) SHEET CONVEYING APPARATUS AND IMAGE FORMING APPARATUS

(71) Applicants: Konica Minolta, Inc., Tokyo (JP); KONICA MINOLTA TECHNOLOGY DEVELOPMENT (WUXI) CO., LTD., Wuxi, Jiangsu (CN)

(72) Inventors: Yoshiki Omichi, Toyokawa (JP); Teruo Nagashima, Tokyo (JP); Yunzhen Yang, Jiangsu (CN); Linfeng Zhou, Jiangsu (CN); Zhongqi Cao, Jiangsu (CN); Jianming Shi, Jiangsu (CN); Shuang Chu, Jiangsu (CN)

(73) Assignees: KONICA MINOLTA, INC., Tokyo (JP); KONICA MINOLTA TECHNOLOGY DEVELOPMENT (WUXI) CO., LTD., Jiangsu (CN)

( * ) Notice: Subject to any disclaimer, the term of this patent is extended or adjusted under 35 U.S.C. 154(b) by 0 days. days.

(21) Appl. No.: 15/459,812

(22) Filed: Mar. 15, 2017

(65) Prior Publication Data

US 2017/0267474 A1 Sep. 21, 2017

(30) Foreign Application Priority Data

Mar. 15, 2016 (CN) ..... 2016 1 0147388

(51) Int. Cl.
*B65H 5/36* (2006.01)
*B65H 5/38* (2006.01)
(Continued)

(52) U.S. Cl.
CPC ..... *B65H 5/38* (2013.01); *B65H 1/266* (2013.01); *B65H 1/28* (2013.01); *B65H 3/06* (2013.01);
(Continued)

(58) Field of Classification Search
CPC ... B65H 5/36; B65H 5/38; B65H 3/66; B65H 3/68; B65H 9/004; B65H 9/006;
(Continued)

(56) References Cited

U.S. PATENT DOCUMENTS 8,419,006 B2 * 4/2013 Imura ..... B65H 85/00 271/3.14
8,725,056 B2 * 5/2014 Ichikawa ..... B65H 5/062 399/388
(Continued)

FOREIGN PATENT DOCUMENTS

JP 2005001787 A * 1/2005
JP 2009083957 A * 4/2009
JP 2015006950 A 1/2015

*Primary Examiner* — Luis A Gonzalez
(74) *Attorney, Agent, or Firm* — Cantor Colburn LLP

(57) ABSTRACT

The present sheet conveying apparatus includes: a resist roller pair that corrects skew of a sheet conveyed from a sheet supplying unit; and a guide portion disposed at an upstream side relative to the resist roller pair in a sheet conveying direction, the guide portion including a first guide and a second guide disposed opposite to the first guide with a sheet conveying path therebetween, the second guide being located at a projection side of a curved portion formed in the sheet when a tip of the sheet is conveyed to a nip portion of the resist roller pair that is stopped, the second guide being divided into a plurality of divided guides in an axial direction of the resist roller pair, a flexible film being disposed to cover at least a portion of a space between the plurality of divided guides.

10 Claims, 15 Drawing Sheets

(51) Int. Cl.

| | |
|---|---|
| ***B65H 9/14*** | (2006.01) |
| ***B65H 9/00*** | (2006.01) |
| ***B65H 1/26*** | (2006.01) |
| ***B65H 1/28*** | (2006.01) |
| ***B65H 3/06*** | (2006.01) |
| ***B65H 7/02*** | (2006.01) |
| ***G03G 15/00*** | (2006.01) |
| ***G03G 21/16*** | (2006.01) |

(52) U.S. Cl.
CPC ..... *B65H 5/36* (2013.01); *B65H 7/02* (2013.01); *B65H 9/004* (2013.01); *B65H 9/006* (2013.01); *G03G 15/5029* (2013.01); *G03G 15/6567* (2013.01); *G03G 21/1633* (2013.01); *B65H 2404/56* (2013.01); *B65H 2801/06* (2013.01); *G03G 2215/00565* (2013.01); *G03G 2215/00611* (2013.01)

(58) Field of Classification Search
CPC .... B65H 9/008; B65H 9/002; B65H 2404/56; B65H 2301/51212; G03G 21/1633; G03G 21/1623; G03G 21/1638
See application file for complete search history.

(56) References Cited

U.S. PATENT DOCUMENTS 9,016,690 B2 * 4/2015 Fukunaga ..... G03G 21/1633 271/273
9,688,495 B2 * 6/2017 Hirahara ..... B65H 29/52

* cited by examiner

SHEET CONVEYING APPARATUS AND IMAGE FORMING APPARATUS

CROSS REFERENCE TO RELATED APPLICATIONS

This application is based on Chinese Patent Application No. 201610147388.7 filed with the Chinese Patent Office on Mar. 15, 2016, the entire content of which is hereby incorporated by reference.

BACKGROUND OF THE INVENTION

Field of the Invention

The present invention relates to a sheet conveying apparatus that conveys a sheet to a resist roller pair of an image forming apparatus, and an image forming apparatus including the sheet conveying apparatus.

Description of the Related Art

Generally, for an image forming apparatus including a sheet conveying apparatus, a resist roller pair is disposed to correct skew of a sheet before the sheet enters an image forming unit. When the tip of the sheet is brought into contact with the resist roller pair that is stopped, the tip of the sheet is stopped. Since conveyance by a conveying roller at an upstream side relative to the resist roller pair is continued after the tip of the sheet is stopped, the sheet is curved to form a loop. Accordingly, the loop of the sheet is likely to come into contact with a guide. In this case, unless a certain distance is secured for a guide space of the conveyance guide at the upstream side relative to the resist roller pair in a direction orthogonal to the sheet conveying direction, wrinkles occur in the sheet and noise is generated during the conveyance of the sheet.

As a conventional technique, an image forming apparatus described in Japanese Laid-Open Patent Publication No. 2015-006950 below has been known. In the image forming apparatus, a sensor/detector is disposed at an upstream side relative to a resist roller pair in a sheet conveying direction to detect a sheet. The sensor/detector has one end inserted in a retreat portion disposed at the central portion of a conveyance guide that conveys a sheet to the resist roller pair. Accordingly, the conveyance guide is divided into two portions by the retreat portion. Moreover, a guide film is disposed on the conveyance guide. The guide film is adhered to the conveyance guide except for the above retreat portion. Accordingly, sheets can be guided to the resist roller pair.

SUMMARY OF THE INVENTION

In the image forming apparatus described in Japanese Laid-Open Patent Publication No. 2015-006950, the conveyance guide provided with the retreat portion is disposed at the main body side of the apparatus, i.e., the recess side of the loop formed in the sheet. In this configuration, a gap is caused at the conveyance guide due to the retreat portion; however, this does not affect the formation of the loop of the sheet because the conveyance guide is located at the recess side and never comes into contact with the sheet during a period in which the loop is formed in the sheet. However, this configuration does not take the following case into consideration: the conveyance guide provided with the retreat portion is located at the projection side of the loop of the sheet. When the conveyance guide is disposed at the projection side of the loop of the sheet, the sheet enters the space of the retreat portion, with the result that the loop may be deformed. If the sheet is conveyed to a nip portion of the resist roller pair without any countermeasure, wrinkles occur in the sheet.

The present invention has been made in view of the above problem. An object thereof is to provide a sheet conveying apparatus that reduces and eliminates occurrence of wrinkles during a conveying process by reducing a gap effectively and smoothly even if the gap exists when a conveyance guide is disposed at the projection side of a loop of a sheet, as well as an image forming apparatus including the sheet conveying apparatus.

In order to achieve the object, a sheet conveying apparatus according to a first embodiment includes: a resist roller pair that corrects skew of a sheet conveyed from a sheet supplying unit; and a guide portion disposed at an upstream side relative to the resist roller pair in a sheet conveying direction, the guide portion including a first guide and a second guide disposed opposite to the first guide with a sheet conveying path therebetween, the second guide being located at a projection side of a curved portion formed in the sheet when a tip of the sheet is conveyed to a nip portion of the resist roller pair that is stopped, the second guide being divided into a plurality of divided guides in an axial direction of the resist roller pair, a flexible film being disposed to cover at least a portion of a space between the plurality of divided guides.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
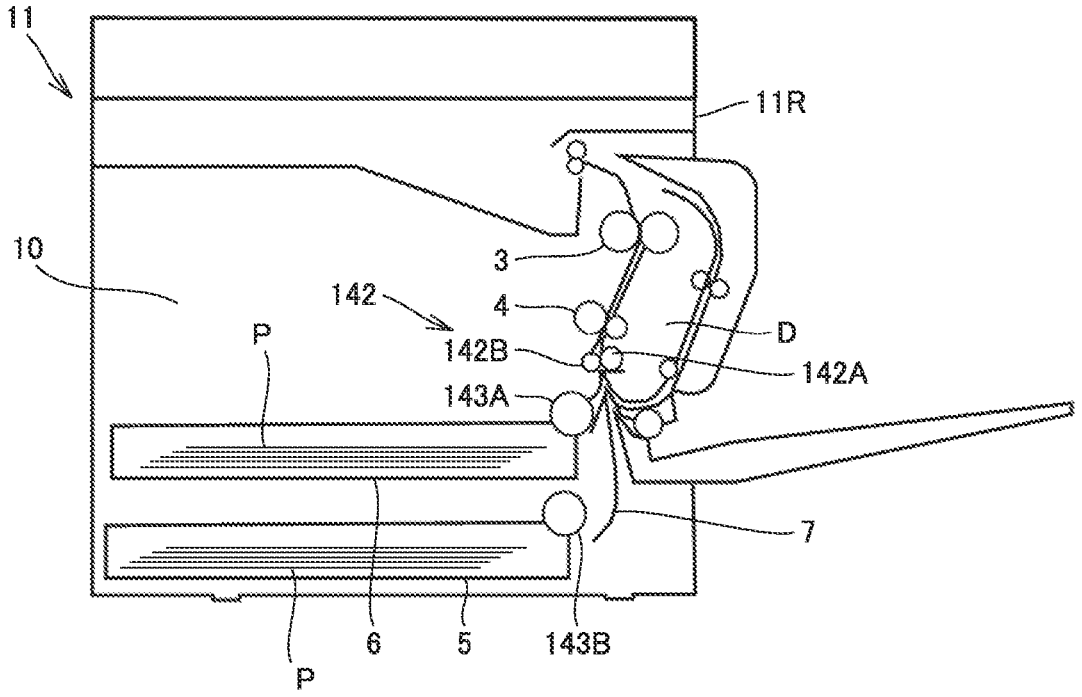
FIG. 1 is a cross sectional view showing an image forming apparatus of the present embodiment.

The following describes a sheet conveying apparatus and an image forming apparatus in each embodiment based on the present invention with reference to figures. In the embodiment described below, when a number, an amount, and the like are mentioned, the scope of the present invention is not necessarily limited by the number, the amount, and the like unless otherwise noted particularly. The same reference characters are given to the same or equivalent components, and they may not be described repeatedly. Moreover, each of the figures is not illustrated in accordance with an actual size scale. In order to facilitate understanding of a structure, some parts of the figures are illustrated in a changed scale to clarify the structure.

First, a principle of the image forming apparatus will be described briefly. The image forming apparatus includes a sheet supplying unit, a sheet conveying unit, a developing unit, a fixing unit, and a sheet discharging unit.

A sheet supplying roller is disposed at the sheet conveying unit. A plurality of sheets are stored in the sheet supply unit such that the sheets are stacked on one another. The sheet supplying roller extracts the sheets one by one from the sheet supplying unit, and conveys the sheets to the developing unit. The sheet conveying unit of the present embodiment will be described later.

A photoconductor drum is disposed at the developing unit. Along a rotation direction of the photoconductor drum, a charger, an exposing device, a developing device, a transferring roller, and a cleaner are disposed. The transferring roller comes into abutment with a surface of the photoconductor drum to form a transferring nip portion. The drum surface of the photoconductor drum is uniformly charged by the charger. The uniformly charged drum surface is irradiated with light from the exposing device, thereby removing charges from the irradiated portion to form an electrostatic latent image. The electrostatic latent image is supplied with toner from the developing unit, and therefore becomes a toner image. The toner image thus formed on the drum surface is conveyed to the nip portion of the transferring roller due to rotation of the photoconductor drum, and is formed on a conveyed sheet. Toner remaining on the drum surface of the photoconductor drum after transferring the toner image is removed by the cleaner. Then, the sheet having the toner image transferred thereto is conveyed to the fixing unit.

The fixing unit includes: a fixing roller (heating roller); and a pressure roller pressed against the fixing roller to form a nip portion of the fixing roller. The sheet having the toner image transferred thereto is conveyed with the sheet being sandwiched by the nip portion of the fixing roller. On this occasion, the sheet is heated by the fixing roller and is pressed by the pressure roller, thereby fixing and settling the toner on the surface thereof. In the sheet discharging unit, a discharging roller pair, a discharging tray, a sheet re-supplying roller, and the like are disposed. The sheet having the toner image fixed thereto is discharged to a discharging tray by the discharging roller pair when an image is supposed to be formed only on that surface.

On the other hand, when images are supposed to be formed on both the front and backside surfaces of the sheet, the sheet having the toner image fixed on the front surface is reversed from its front surface to its backside surface by reversing (inversing) the rotation of the discharging roller pair. Then, the sheet is conveyed by the sheet re-supplying roller and the like to the developing unit again to transfer a toner image onto the backside surface in the same manner as that for the front surface. The sheet is conveyed to the fixing unit to fix the toner image, and is then discharged to the discharging tray by the discharging roller pair.

In the description above, the image forming apparatus of the present invention has been generally described. The following describes a sheet conveying apparatus of the present embodiment with reference to FIG. 1 and FIG. 2.

Figure 2:
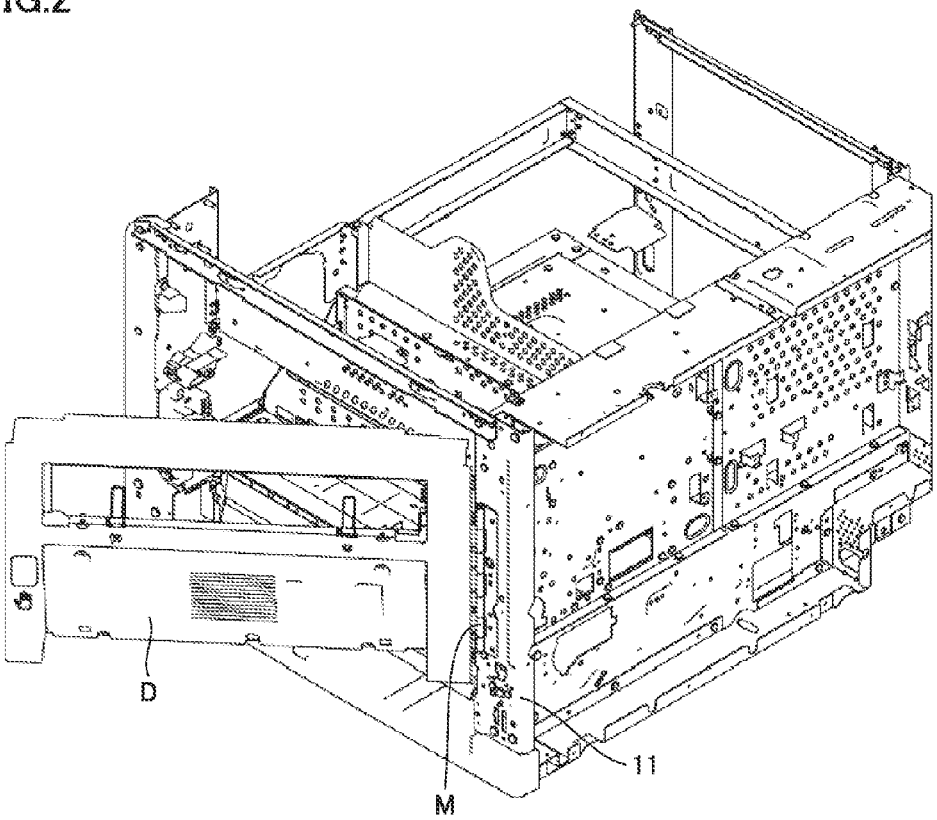
FIG. 2 is a perspective view showing a frame configuration of the image forming apparatus of the present embodiment.

FIG. 1 shows an internal structure of an image forming apparatus 10 according to one embodiment. In FIG. 1, the developing unit, the fixing unit, and the like are omitted to illustrate a configuration of the sheet conveying apparatus in detail. FIG. 2 is a perspective view showing a frame configuration of an apparatus main body 11.

As shown in FIG. 1, a first sheet cassette 5 and a second sheet cassette 6 both attachable/detachable to/from apparatus main body 11 are arranged in a plurality of levels in a perpendicular direction. On the right side of first sheet cassette 5 and second sheet cassette 6 overlapping with each other in the perpendicular direction in the figure, a sheet conveying path 7 is provided to extend in the perpendicular direction. Sheet conveying path 7 is a longitudinal path for conveying a sheet P from a lower side to an upper side in the perpendicular direction. In each of first sheet cassette 5 and second sheet cassette 6, a plurality of sheets P are stored such that sheets P are stacked on one another. First sheet cassette 5 and second sheet cassette 6 are included in the sheet supplying unit.

From the upstream side to the downstream side in the sheet conveying direction, a resist roller pair 142, a transferring roller pair 4, a fixing roller pair 3, and the like are disposed in this order. In the present embodiment, resist roller pair 142 is constructed as monolithic rollers. In this configuration, toner generated in the sheet supplying unit is collected by charging the monolithic rollers. This prevents the toner from entering the image forming unit, thereby obtaining an excellent image. However, this is just one of suitable embodiments and this configuration is not limited to such a suitable embodiment. Moreover, resist roller pair 142 is disposed at the upstream side relative to transferring roller pair 4 in the conveyance direction of sheet P. Sheet P is extracted from the sheet cassette, and is then supplied to resist roller pair 142 via sheet conveying path 7. When resist roller pair 142 is stopped, the edge of the tip of sheet P is temporarily stopped but conveyance of the sheet is continued by a conveying roller pair (not shown) at the upstream side relative to resist roller pair 142, thereby forming a loop in sheet P. After the formation of the certain loop, resist roller pair 142 conveys sheet P again to correct skew of sheet P. Then, in accordance with a timing of image formation by the image forming unit (not shown), sheet P is conveyed by resist roller pair 142. Resist roller pair 142 includes a resist follower roller 142A (first roller) and a resist roller 142B (second roller). Resist follower roller 142A is disposed at the side wall 11R side relative to sheet conveying path 7. Resist roller 142B is disposed opposite to resist follower roller 142A with sheet conveying path 7 therebetween. A resist nip portion, through which sheet P passes, is formed between resist follower roller 142A and resist roller 142B.

On the right side of first sheet cassette 5 and second sheet cassette 6, a sheet supplying roller 143A and a sheet supplying roller 143B are disposed to face the tips of sheets P. Sheet supplying rollers 143A and 143B are driven to rotate to convey sheets P to sheet conveying path 7. Sheet supplying roller 143A is disposed at the upstream side relative to resist roller pair 142 in the sheet conveying direction. Similarly, sheet supplying roller 143B is disposed at the upstream side relative to resist roller pair 142 in the sheet conveying direction. Of course, this is just an example and sheet P may be conveyed to sheet conveying path 7 in a different manner. Moreover, as shown in FIG. 2, a side gate D is disposed at side wall 11R of apparatus main body 11. Side gate D is configured to rotate about supporting points M located at the upper and lower sides of side wall 11R so as to open/close with respect to apparatus main body 11. When closed, side gate D becomes a part of side wall 11R. As compared with an apparatus opened and closed with a supporting point located at a lower side of the front or backside portion of apparatus main body 11, an opening/closing angle of side gate D can be made larger in the configuration in which the supporting points are located at the upper and lower sides of side wall 11R of apparatus main body 11 as in the present embodiment. This is advantageous in dealing with jamming.

Figure 3:
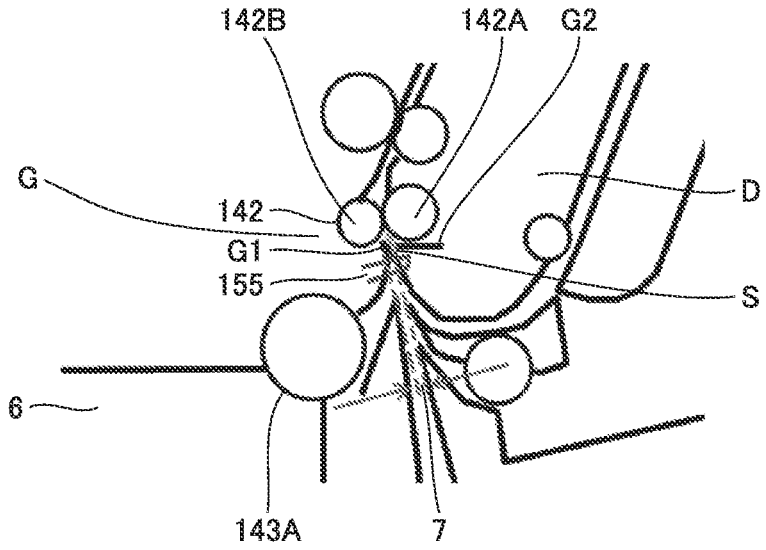
FIG. 3 is a cross sectional view showing a detained structure near a resist roller pair of the present embodiment.
Figure 4:
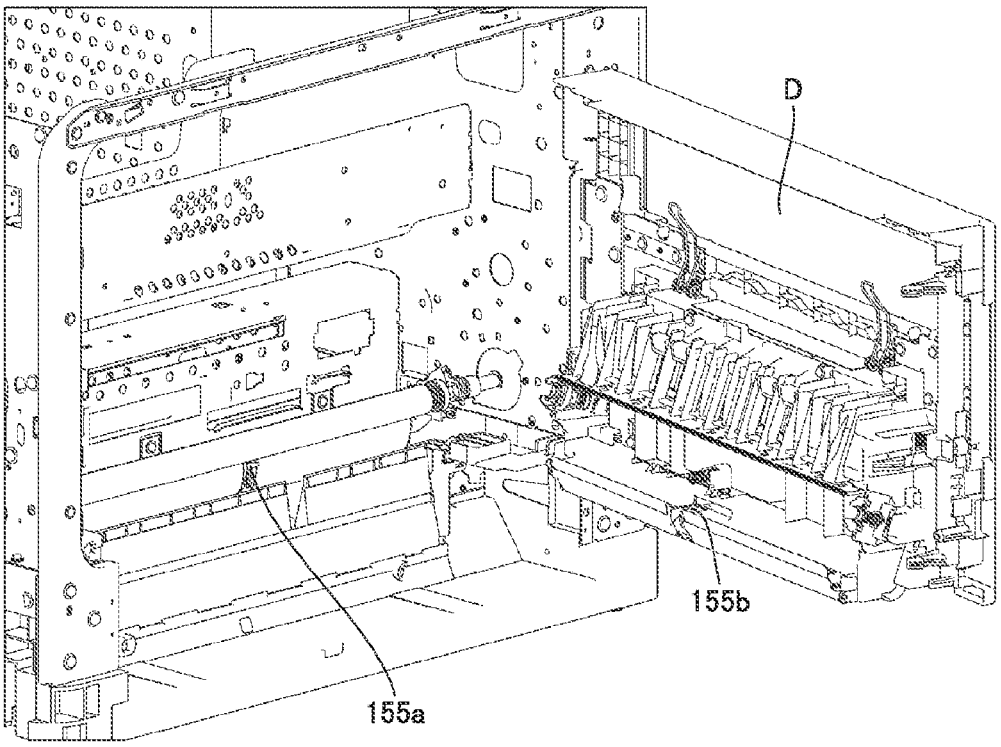
FIG. 4 is a perspective view showing an internal structure when a side gate is opened in the present embodiment.
Figure 5:
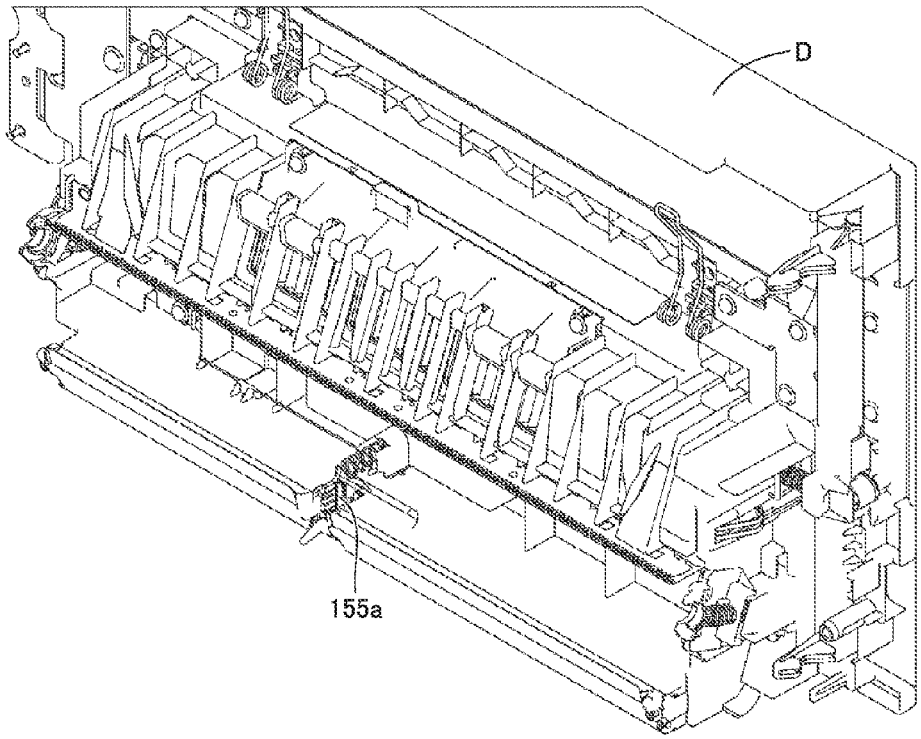
FIG. 5 is an enlarged view showing a modification of a sheet sensor in the present embodiment.

With reference to FIG. 3 to FIG. 5, the following describes a structure near resist roller pair 142 in detail. FIG. 3 is a cross sectional view showing a configuration near resist roller pair 142 of the present embodiment. FIG. 4 is a perspective view showing an internal structure when side gate D is opened. FIG. 5 is an enlarged view showing a modification of a sheet sensor 155.

As shown in FIG. 3 and FIG. 4, a sheet sensor 155 is disposed at the upstream side relative to and just before resist roller pair 142. Sheet sensor 155 at least includes a sensor main body 155*a* and a receiving portion 155*b*, and may include other necessary components. Sheet sensor 155 has one side projecting into and extending across sheet conveying path 7 and inserted in a second guide G2. During conveyance of sheet P from a sheet cassette to resist roller pair 142 along sheet conveying path 7, sheet sensor 155 detects arrival of sheet P, and in accordance with the detection result, rotation of resist roller pair 142 is controlled by a controller not shown. In the present embodiment, in order to detect all the sheets using sheet sensor 155, sheet sensor 155 is configured to cover the entire cross section of a sheet guide portion G described below, i.e., is configured to extend from a first guide G1 to second guide G2. However, the sensor structure is not limited to this, and there may be employed a different sensor structure for detecting passage of a sheet in the conventional technique.

As shown in FIG. 3, sheet guide portion G is disposed at the upstream side relative to resist roller pair 142. Sheet guide portion G includes: first guide G1 disposed at the apparatus main body 11 side; and second guide G2 disposed, opposite to first guide G1, at the side gate D side with sheet conveying path 7 therebetween. In consideration of convenience in dealing with jamming having occurred, second guide G2 is disposed at side gate D that can be opened and closed from apparatus main body 11. Moreover, since second guide G2 and side gate D are formed in one piece, cost can be reduced. As shown in FIG. 3, when side gate D is closed, a guide space is formed between first guide G1 and second guide G2 as shown by a dotted line surrounded by two arrows in the figure. At the tip of second guide G2, a PET film S is disposed to aid conveyance of the sheet until the sheet reaches the nip portion of resist roller pair 142. Accordingly, sheet P can be guided to a position just before the nip portion of resist roller pair 142 as much as possible, thereby achieving improvement in terms of occurrence of wrinkles in the sheet and correction of sheet skew. In order to avoid interference between resist roller pair 142 and each of PET film S and second guide G2 when opening and closing side gate D, second guide G2 is divided into two portions at the position of sheet sensor 155 along the width direction of sheet conveying path 7, i.e., is configured as a two-stage type. The following describes second guide G2 in detail with reference to figures.

In some apparatuses, resist roller pair 142 may be disposed at side gate D that can be opened and closed to deal with jamming. As compared with such a configuration, precision in position of printing is more likely to be secured by disposing resist roller pair 142 inside apparatus main body 11 in which the photoconductor drum is held. Hence, in the case where resist roller pair 142 is disposed inside apparatus main body 11, sheet guide portion G at the upstream side relative to resist roller pair 142 is divided into first guide G1 disposed inside apparatus main body 11 and second guide G2 disposed at the side gate D side, whereby jamming near resist roller pair 142 can be readily dealt with.

It should be noted that FIG. 4 shows the configuration in which sensor main body 155*a* is provided at the apparatus main body 11 side and receiving portion 155*b* is provided at the side gate D side; however, as shown in FIG. 5, sensor main body 155*a* may be provided at the side gate D side and receiving portion 155*b* may be provided at the apparatus main body 11 side.

Figure 6:
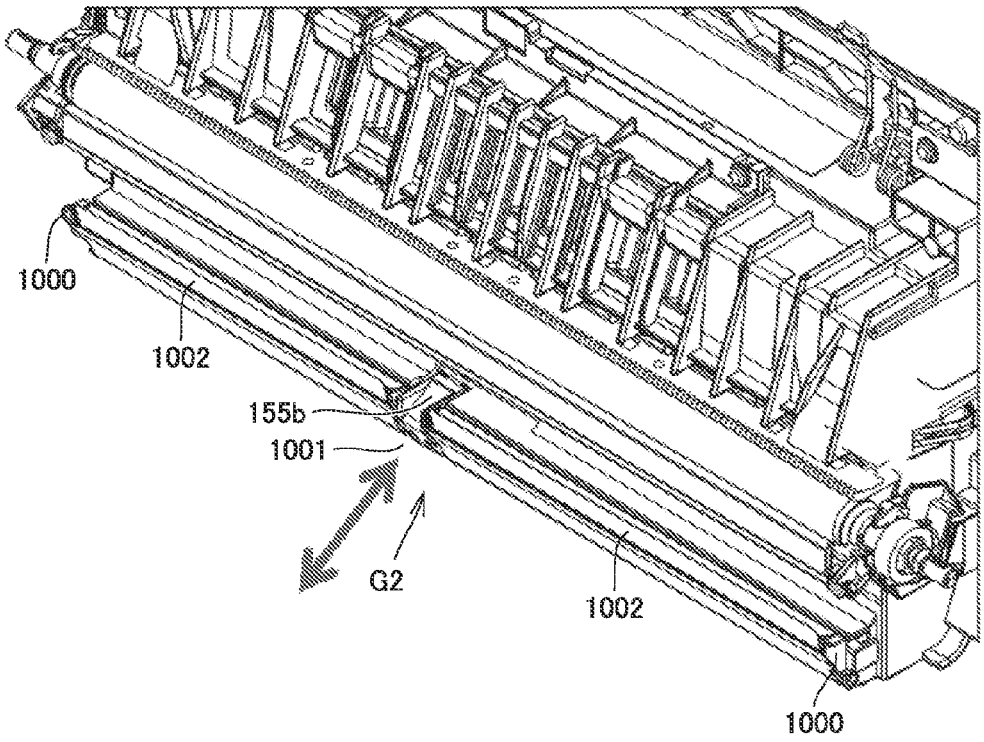
FIG. 6 is a perspective view illustrating a guide portion in the present embodiment.

With reference to FIG. 6, hereinafter, second guide G2 of the present embodiment will be described in detail. FIG. 6 is a perspective view showing a detailed structure of second guide G2 when side gate D is opened. In FIG. 6, a direction indicated by arrows is a forward/backward direction, and a direction orthogonal to the forward/backward direction is a leftward/rightward direction. As shown in FIG. 6, second guide G2 is formed to have a substantially long shape along the leftward/rightward direction, i.e., to extend from the back side to front side of apparatus main body 11. Second guide G2 is fixed to side gate D. The material of second guide G2 is not particularly limited as long as the material does not have an influence over the effect of the present embodiment. When side gate D is closed, second guide G2 faces first guide G1 (not shown) disposed at the apparatus main body 11 side with sheet conveying path 7 therebetween, thereby forming sheet conveyance guide portion G. As shown in FIG. 6, second guide G2 includes projections 1000, an adjustment guide 1001, and movable guides 1002.

In the present embodiment, in order to achieve both improved convenience in dealing with jamming and cost reduction, second guide G2 is disposed at side gate D that can be freely opened and closed from apparatus main body 11. In this case, if second guide G2 is configured as a monolithic guide, second guide G2 may interfere with resist roller pair 142 when opening and closing side gate D. Hence, in the present embodiment, as shown in FIG. 6, second guide G2 is divided into two movable guides 1002 in the leftward/rightward direction, i.e., the sheet width direction. Moreover, in order to smoothly insert the tip of second guide G2 to the nip portion of resist roller pair 142 when opening and closing side gate D and aid conveyance of sheet P until sheet P reaches the nip portion of resist roller pair 142, each of movable guides 1002 is configured to freely rotate, in the forward/backward direction, about an axis that is along the leftward/rightward direction, i.e., is configured to be rotatable in a direction to come close to or separate away from first guide G1.

In the present embodiment, in order to secure a space between the guides, projections 1000 are disposed at the left and right ends of second guide G2, and are brought into abutment with first guide G1 to form a guide space. The height of each of projections 1000 from second guide G2 may be a predetermined constant height, or may be a different height such as a height adjustable using a spring.

When side gate D is closed, projections 1000 are brought into abutment with first guide G1 at the apparatus main body 11 side, thereby forming a space between first guide G1 and second guide G2 to secure a minimum space through which the sheet passes. Of course, the position of each of projections 1000 is not limited to this. Projections 1000 may be disposed at the first guide G1 side as long as the space can be secured between the guides.

Moreover, in the present embodiment, second guide G2 is divided into two at the central portion of sheet conveying guide G. Thus, the two divided portions of second guide G2 have symmetrical lengths, thereby securing the guide space more effectively. Of course, the position of dividing second guide G2 is not limited to this. The position of dividing may be any position as long as the position does not have an influence over implementation of the present embodiment.

In the present embodiment, since second guide G2 is a movable guide (not fixable) and is divided into two, it possibly cannot be ensured that the space therebetween at the region of dividing second guide G2 is the same as the space therebetween at each of the both ends of second guide G2 during the sheet conveyance process when projections 1000 are disposed at the both ends of second guide G2. In addition, due to an error of a component such as deformation, it possibly cannot be ensured that the space therebetween at the region of dividing second guide G2 is the same as the space therebetween at each of the both ends (projections 1000) (since second guide G2 has no component fixed to first guide G1). In this case, in order to attain a uniform space between first guide G1 and second guide G2 in the sheet width direction, adjustment guide 1001 is disposed at second guide G2 to join the two divided portions of second guide G2. When adjustment guide 1001 is moved in the forward/backward direction, i.e., the direction orthogonal to the sheet conveying direction, the space can be adjusted between first guide G1 and the vicinity of the region of dividing second guide G2, thereby securing a uniform space between second guide G2 and first guide G1 in the sheet conveyance direction. Accordingly, improvement is attained with regard to a problem such as wrinkles in the sheet. Moreover, since the structure of the sheet sensor extending from first guide G1 to second guide G2 in the present embodiment is employed, a certain insertion distance needs to be secured in second guide G2 to prevent chattering. Hence, by disposing adjustment guide 1001, the insertion distance of sheet sensor 155 in second guide G2 can be secured. This is advantageous for stability of sheet detection by the sheet sensor.

Preferably, a fitting portion, i.e., a supporting point may be disposed in adjustment guide 1001 to move the two divided portions of second guide G2 in synchronization with each other. For example, a lateral shaft component is disposed to extend through and fix the two divided portions of second guide G2 in the leftward/rightward direction in FIG. 6 and adjustment guide 1001. Accordingly, the whole of second guide G2 can be rotated or moved in the forward/backward direction in FIG. 6, thereby further securing the guide space. Accordingly, uniformity of the guide space can be secured. Further, since second guide G2 is divided into two in the present embodiment, a gap may be caused between second guide G2 and adjustment guide 1001. Therefore, when the two divided portions are configured to be moved in synchronization with each other, uniformity of the space between the guides is maintained effectively, thereby avoiding occurrence of sheet wrinkles during the conveyance process. Moreover, second guide G2 described above is preferably configured to be movable about the supporting point in adjustment guide 1001. Of course, other configurations may be employed as long as the configurations do not have an influence over the effect of the present embodiment.

Moreover, in the present embodiment, second guide G2 is divided into two, and adjustment guide 1001 is disposed at the portion of dividing; however, second guide G2 is not limited to this. For example, second guide G2 may be divided into a plurality of portions. In this case, adjustment guides 1001 may be disposed between the divided guides. Moreover, in the present embodiment, second guide G2 is disposed at the side gate D side; however, this is just one of suitable embodiments. Other configurations in each of which second guide G2 is not disposed at the side gate D side may be employed as long as the space for conveyance of sheet can be formed between first guide G1 and second guide G2. Moreover, in the present embodiment, movable guides 1002 are configured to be rotatable; however, this is just one of suitable embodiments. When second guide G2 is not disposed at side gate D, a fixed guide may be disposed instead of movable guides 1002.

In the present embodiment, in order to eliminate the gap between adjustment guide 1001 and each movable guide 1002 and secure the guide space, the following configuration is employed: a flexible film is adhered onto a space between adjustment guide 1001 and each of divided movable guides 1002. With reference to the figures, this will be hereinafter described in detail.

Figure 7:
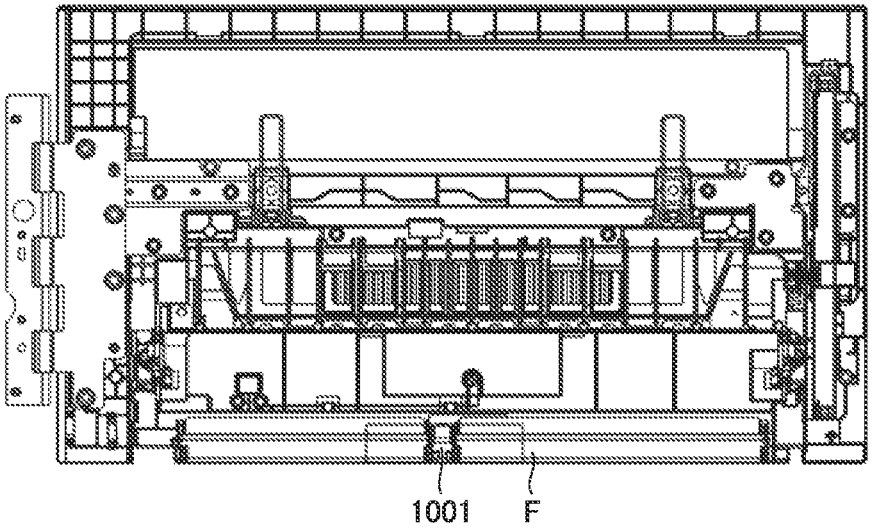
FIG. 7 is a perspective view illustrating an exemplary method of adhering a film in the present embodiment.
Figure 8:
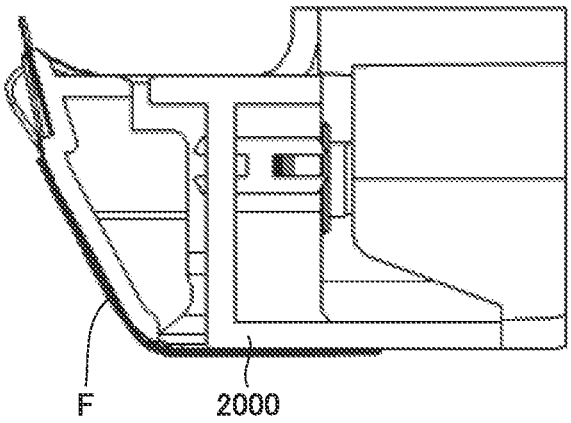
FIG. 8 is a side view of FIG. 7.
Figure 9:
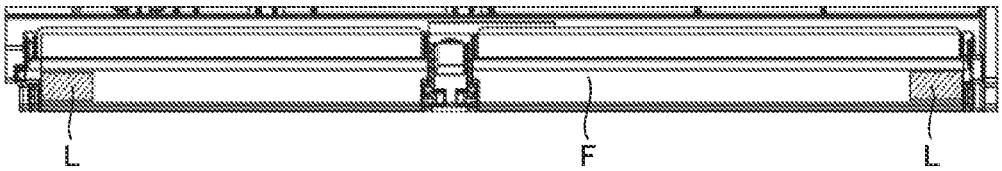
FIG. 9 is a first diagram showing a method of adhering the film.
Figure 10:
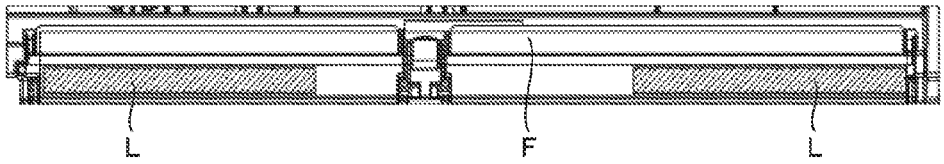
FIG. 10 is a second diagram showing a method of adhering the film.

FIG. 7 is a perspective view of one embodiment in which film F is adhered onto the space between adjustment guide 1001 and movable guide 1002. FIG. 8 is a cross sectional view thereof. In the present embodiment, since second guide G2 is divided into two and adjustment guide 1001 is disposed at the portion of dividing, a space or gap is formed between adjustment guide 1001 and each of divided movable guides 1002. In that case, when sheet P is conveyed between first guide G1 and second guide G2, a loop is formed by resist roller pair 142 and the projection of the loop may enter the space, with the result that the sheet may be damaged. Moreover, since there is a gap between movable guide 1002 and adjustment guide 1001, wrinkles are likely to occur in sheet P. In order to overcome such problems, in the present embodiment, film F is adhered onto second guide G2 as shown in FIG. 7 and FIG. 8. As an example, film F is configured to cover the space between adjustment guide 1001 and each of the two divided portions of second guide G2, i.e., movable guides 1002 in the lateral direction of second guide G2. In the longitudinal direction, as shown in FIG. 8, film F extends to a frame 2000 to cover a housing of second guide G2 at the upstream side in the sheet conveying direction. Frame 2000 is a component disposed at side gate D and supporting second guide G2. Since film F extends to frame 2000, a space between movable guide 1002 and the housing is covered, film F is not affected by collapse of movable guide 1002 and reinforces movable guide 1002 longitudinally, and a maximum space between the guides can be secured. Of course, the adhering method described above is just an example, and various types of adhering methods can be employed as long as the above effect can be realized. Moreover, in the present embodiment, film F employs a flexible PET film but is not limited to this. For example, a flexible material such as a gummed tape may be used as long as the above effect can be realized. Moreover, in the present embodiment, when a detector such as sheet sensor 155 is employed, film F may be provided with a window portion through which one side of sheet sensor 155 is inserted.

In the present embodiment, film F extends to frame 2000 to cover the housing of second guide G2 at the upstream side in the sheet conveying direction; however, this is just one of suitable embodiments. Film F may be configured to cover only the surface of second guide G2, or may be configured to cover the surface of second guide G2 and the housing thereof at the upstream side in the sheet conveying direction. Any configuration may be employed as long as the effect of the present embodiment can be realized. Moreover, in the above embodiment, as an example, it has been illustrated that the space between adjustment guide 1001 and movable guide 1002 is covered; however, when a fixed guide is included rather than the adjustment guide, a space between the fixed guide and the movable guide may be covered. Moreover, when there are a plurality of movable guides, at least a portion of the space between the plurality of movable guides may be covered.

Figure 11:
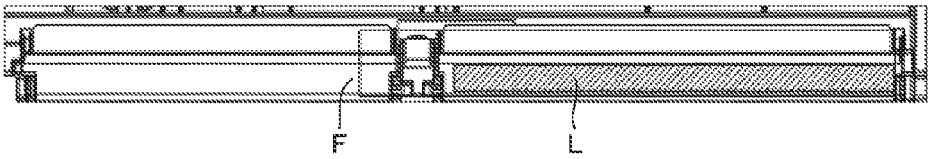
FIG. 11 is a third diagram showing a method of adhering the film.
Figure 12:
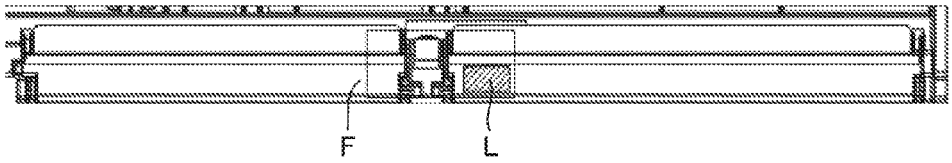
FIG. 12 is a fourth diagram showing a method of adhering the film.
Figure 13:
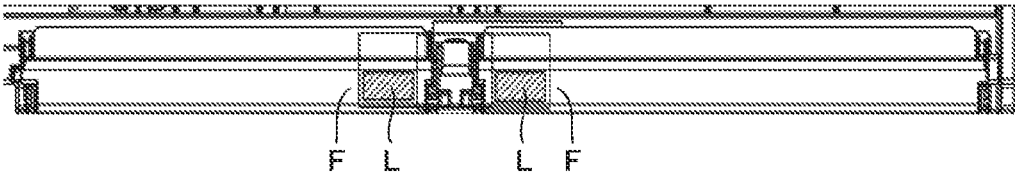
FIG. 13 is a fifth diagram showing a method of adhering the film.
Figure 14:
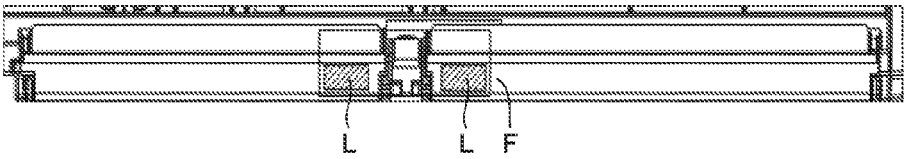
FIG. 14 is a sixth diagram showing a method of adhering the film.

FIG. 9 to FIG. 14 illustrate methods of adhering film F. In each of FIG. 9 and FIG. 10, one film F is used and has a length as large as the length of second guide G2. An adhesive agent L is provided at sides of the movable guides of second guide G2. A difference between FIG. 9 and FIG. 10 lies in a difference in length of adhesive agent L. By providing them in this way, the gap in second guide G2 is entirely covered, thereby securing the space between the guides. In FIG. 11, one film F is used and extends from one end toward the other end of second guide G2 to cover the space between each of the movable guides and the adjustment guide. Adhesive agent L is provided only on one movable guide. In FIG. 12, one film F is used and is disposed to cover the adjustment guide and extend by a small distance to the movable guides to cover the space between each of the movable guides and the adjustment guide. Adhesive agent L is provided only on one movable guide. In FIG. 13, two films F are used and are each disposed in the same manner as in FIG. 12. Two films F have overlapping portions that cover the adjustment guide. Adhesive agent L is provided on both the movable guides. In FIG. 14, one film F is used and is disposed to cover the adjustment guide and extend by a small distance to the movable guides to cover the space between each of the movable guides and the adjustment guide. Adhesive agent L is provided on both the movable guides. Although the above-described various types of the adhering methods are different from one another in terms of the number of film(s) F, the position(s) of film(s) F, and the position(s) of adhesive agent L, the effect of the present embodiment can be realized by each of the adhering methods.

In the above adhering methods, adhesive agent L may be provided only on the movable guide(s) and may be provided only on the adjustment guide. When provided only on the movable guide(s), the movable guides can be avoided from being moved in relation with the adjustment guide and the space can be secured more advantageously. When provided only on the adjustment guide, the gap can be covered effectively. Of course, the methods of providing adhesive agent L are not limited to these. Adhesive agent L may be provided on both the movable guide(s) and the adjustment guide. In this case, the gap can be covered effectively and the space at the central portion of sheet guide portion G can be stabilized.

By disposing film F, the tip of sheet P and the projection of the formed loop of sheet P do not enter the space formed by the divided guides when sheet P is conveyed between first guide G1 and second guide G2, whereby sheet P is unlikely to be damaged. Moreover, since film F allows the two divided portions of second guide G2 to be moved in synchronization with each other, uniformity of the space between the guides can be further secured.

Moreover, second guide G2 is divided into two in the sheet width direction at the position of sheet sensor 155 disposed just before resist roller pair 142, is configured to be movable, and has the projections at the both ends of second guide G2 in the forward/backward direction of apparatus main body 11. Accordingly, a minimum space between the guides can be secured without interference in opening and closing side gate D when dealing with jamming or the like.

Moreover, second guide G2 is provided with the adjustment guide joined to second guide G2 divided into two, and the adjustment guide is configured to be movable in the direction orthogonal to the sheet conveying direction. Accordingly, uniformity of the guide space can be secured. Hence, even when sheet P is conveyed in such a manner that the loop of sheet P formed at the upstream side relative to resist roller pair 142 is in contact with the guide, occurrence of wrinkles in the sheet can be avoided.

Heretofore, the present embodiment has been described in detail with reference to the figures. However, the present embodiment is not limited to this. For example, one conveying roller pair may be added independently between first sheet cassette 5 and second sheet cassette 6. Specifically, a second conveying path for conveying a sheet from second sheet cassette 6 to resist roller pair 142 is set to be longer than a first conveying path for conveying a sheet from first sheet cassette 5 to resist roller pair 142, a conveying roller pair is additionally disposed in the second conveying path, and this conveying roller pair is always rotated during the sheet conveyance period. Thus, the conveying roller pair does not have a clutch and always continues to send sheets to form a loop between the conveying roller pair and the resist roller pair, thereby attaining excellent conveyance without affecting the conveyance speed of the resist roller pair.

Figure 15:
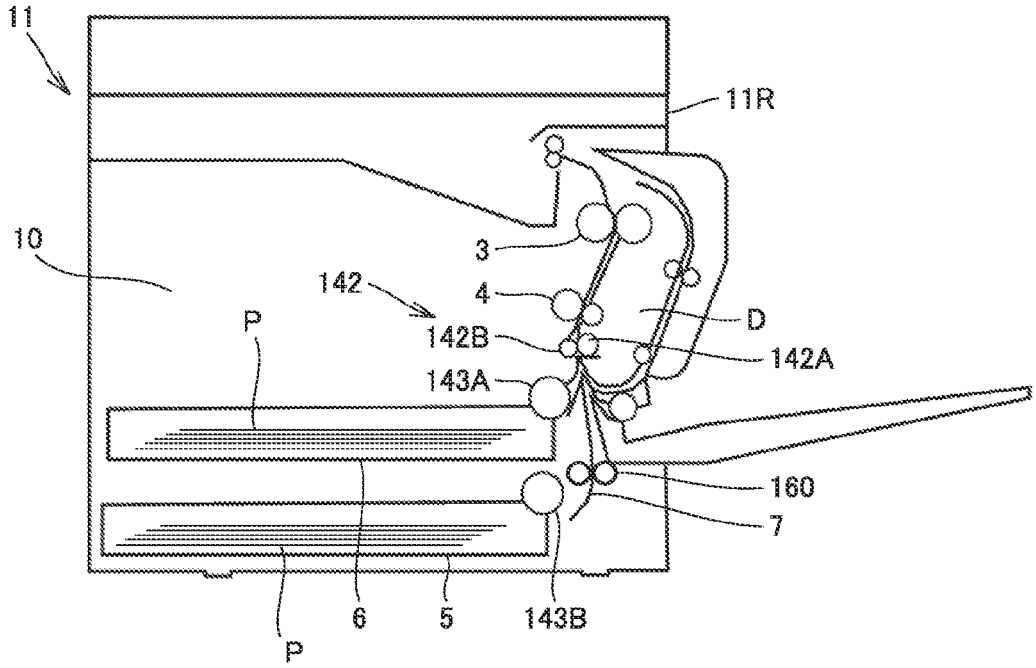
FIG. 15 is a cross sectional view showing an image forming apparatus in another form of the present embodiment.

It should be noted that as shown in FIG. 15, image forming apparatus 10 may be configured such that a roller pair 160 is disposed at a position between sheet supplying roller 143A and sheet supplying roller 143B.

A sheet conveying apparatus according to a first embodiment includes: a resist roller pair that corrects skew of a sheet conveyed from a sheet supplying unit; and a guide portion disposed at an upstream side relative to the resist roller pair in a sheet conveying direction, the guide portion including a first guide and a second guide disposed opposite to the first guide with a sheet conveying path therebetween, the second guide being located at a projection side of a curved portion formed in the sheet when a tip of the sheet is conveyed to a nip portion of the resist roller pair that is stopped, the second guide being divided into a plurality of divided guides in an axial direction of the resist roller pair, a flexible film being disposed to cover at least a portion of a space between the plurality of divided guides.

A sheet conveying apparatus according to a second embodiment is the sheet conveying apparatus according to the first embodiment, wherein a sheet sensor is disposed at the upstream side relative to the resist roller pair in the sheet conveying direction, and the sheet sensor or a receiving portion of the sheet sensor is disposed between the plurality of divided guides. According to the configuration, all the sheets can be securely detected by the sheet sensor, thereby improving stability of sheet detection.

A sheet conveying apparatus according to a third embodiment is the sheet conveying apparatus according to the second embodiment, wherein the film is provided with a window portion for the receiving portion to permit insertion of the sheet sensor. According to the configuration, all the sheets can be securely detected by the sheet sensor, thereby improving stability of sheet detection.

A sheet conveying apparatus according to a fourth embodiment is the sheet conveying apparatus according to any one of the first embodiment to the third embodiment, the sheet conveying apparatus further including a side gate that is able to be opened and closed from the apparatus main body, wherein the second guide is provided at the side gate side, and the plurality of divided guides are movable in a direction to come close to or separate away from the first guide. According to the configuration, the second guide was disposed at the side gate, thereby attaining cost reduction. Moreover, since the divided guides are movable, they can be smoothly inserted into the nip portion of the resist roller pair while avoiding interference with the resist roller pair when the side gate is closed.

A sheet conveying apparatus according to a fifth embodiment is the sheet conveying apparatus according to any one of the first embodiment to the fourth embodiment, wherein an adjustment guide movable in a direction orthogonal to the sheet conveying direction is disposed between the divided guides, and the film covers at least a portion of a space between each of the divided guides and the adjustment guide. According to the configuration, by moving the adjustment guide, the space between the first guide and the second guide becomes uniform in the direction orthogonal to the sheet conveying direction. Accordingly, stability of conveyance of sheets to the rollers at the downstream side can be maintained, thereby avoiding occurrence of wrinkles in the sheets.

A sheet conveying apparatus according to a sixth embodiment is the sheet conveying apparatus according to any one of the first embodiment to the fifth embodiment, wherein the film has a length as large as a length of the second guide in the axial direction of the resist roller pair. According to the configuration, the gap in the second guide can be covered entirely. This is advantageous in securing the space between the guides.

A sheet conveying apparatus according to a seventh embodiment is the sheet conveying apparatus according to any one of the first embodiment to the sixth embodiment, the sheet conveying apparatus further including a frame that supports the second guide, wherein the film covers to extend to the frame. According to the configuration, the space between the movable guide and the housing can be covered with the film. Moreover, this does not have an influence over collapse of the movable guides and can reinforce the second guide.

A sheet conveying apparatus according to an eighth embodiment is the sheet conveying apparatus according to any one of the fifth embodiment to the seventh embodiment, wherein an adhesive agent for adhering the film is provided on at least a divided guide of the divided guides and the adjustment guide. According to the configuration, the movable guides can be avoided from being moved in relation with the adjustment guide. Moreover, this is more advantageous in securing the space.

A sheet conveying apparatus according to a ninth embodiment is the sheet conveying apparatus according to any one of the fourth embodiment to the eighth embodiment, wherein the side gate is opened and closed to rotate about a supporting point disposed at an upper side and a lower side of a side wall of the apparatus main body, and the adhesive agent is adhered to a divided guide or adjustment guide separated away from the supporting point. Accordingly, an opening/closing angle of the side gate relative to the apparatus main body becomes large, thereby improving convenience in dealing with jamming. Furthermore, since the door of the side gate faces the user, convenience is improved further.

A sheet conveying apparatus according to a tenth embodiment is the sheet conveying apparatus according to any one of the first embodiment to the ninth embodiment, wherein the resist roller pair is monolithic rollers. According to the configuration, by charging the monolithic rollers, toner generated in the sheet supplying unit is collected and the toner is prevented from being entering the image forming unit. Accordingly, an excellent image can be obtained.

A sheet conveying apparatus according to an eleventh embodiment is the sheet conveying apparatus according to any one of the first embodiment to the tenth embodiment, wherein the sheet supplying unit has a first sheet cassette and a second sheet cassette, the sheet conveying apparatus further including: a first conveying path for conveying a sheet from the first sheet cassette to the resist roller pair; and a second conveying path for conveying a sheet from the second sheet cassette to the resist roller pair, wherein the second conveying path is provided to be longer than the first conveying path, and a conveying roller pair that always continues to rotate during a sheet conveyance period is disposed in the second conveying path. Thus, the conveying roller pair does not have a clutch and always continues to send sheets to form a loop between the conveying roller pair and the resist roller pair, thereby attaining excellent conveyance without affecting the conveyance speed of the resist roller pair.

An image forming apparatus according to a twelfth embodiment includes the sheet conveying apparatus of any one of the first embodiment to the eleventh embodiment. According to the configuration, the image forming apparatus can realize the effect described above.

According to the configuration, since the flexible film is adhered, the tip of the sheet and the projection of the loop formed in the sheet do not enter the space between the divided guides, whereby the sheet is unlikely to be damaged. Moreover, by adhering the film, the gap between the divided guides is eliminated, thereby securing the space between the first guide and the second guide. Accordingly, improvement is attained with regard to occurrence of wrinkles in sheets.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A sheet conveying apparatus comprising:

an apparatus main body having a resist roller pair that corrects skew of a sheet conveyed from a sheet supplying unit;

a guide portion disposed at an upstream side relative to the resist roller pair in a sheet conveying direction, the guide portion including a first guide and a second guide disposed opposite to the first guide with a sheet conveying path therebetween; and a side gate that is able to be opened and closed from the apparatus main body;

the second guide being located at a projection side of a curved portion formed in the sheet when a tip of the sheet is conveyed to a nip portion of the resist roller pair that is stopped, the second guide being divided into a plurality of divided guides in an axial direction of the resist roller pair, a flexible film being disposed to cover at least a portion of a space between the plurality of divided guides;

wherein the second guide is provided at the side gate side, the plurality of divided guides are movable in a direction to come close to or separate away from the first guide;

the side gate is opened and closed to rotate about a supporting point disposed at an upper side and a lower side of a side wall of the apparatus main body, and an adhesive agent is adhered to a divided guide or adjustment guide separated away from the supporting point.

2. The sheet conveying apparatus according to claim 1, wherein a sheet sensor is disposed at the upstream side relative to the resist roller pair in the sheet conveying direction, and the sheet sensor or a receiving portion of the sheet sensor is disposed between the plurality of divided guides.

3. The sheet conveying apparatus according to claim 2, wherein the film is provided with a window portion for the receiving portion to permit insertion of the sheet sensor.

4. The sheet conveying apparatus according to claim 1, wherein an adjustment guide movable in a direction orthogonal to the sheet conveying direction is disposed between the divided guides, and the film covers at least a portion of a space between each of the divided guides and the adjustment guide.

5. The sheet conveying apparatus according to claim 4, wherein an adhesive agent for adhering the film is provided on at least a divided guide of the divided guides and the adjustment guide.

6. The sheet conveying apparatus according to claim 1, wherein the film has a length as large as a length of the second guide in the axial direction of the resist roller pair.

7. The sheet conveying apparatus according to claim 1, further comprising a frame that supports the second guide, wherein the film covers to extend to the frame.

8. The sheet conveying apparatus according to claim 1, wherein the resist roller pair is monolithic rollers.

9. The sheet conveying apparatus according to claim 1, wherein the sheet supplying unit has a first sheet cassette and a second sheet cassette, the sheet conveying apparatus further comprising:

a first conveying path for conveying a sheet from the first sheet cassette to the resist roller pair; and a second conveying path for conveying a sheet from the second sheet cassette to the resist roller pair, wherein the second conveying path is provided to be longer than the first conveying path, and a conveying roller pair that always continues to rotate during a sheet conveyance period is disposed in the second conveying path.

10. An image forming apparatus comprising a sheet conveying apparatus, the sheet conveying apparatus including:

an apparatus main body having a resist roller pair that corrects skew of a sheet conveyed from a sheet supplying unit; and a guide portion disposed at an upstream side relative to the resist roller pair in a sheet conveying direction, the guide portion including a first guide and a second guide disposed opposite to the first guide with a sheet conveying path therebetween; and a side gate that is able to be opened and closed from the apparatus main body;

the second guide being located at a projection side of a curved portion formed in the sheet when a tip of the sheet is conveyed to a nip portion of the resist roller pair that is stopped, the second guide being divided into a plurality of divided guides in an axial direction of the resist roller pair, a flexible film being disposed to cover at least a portion of a space between the plurality of divided guides;

wherein the second guide is provided at the side gate side, the plurality of divided guides are movable in a direction to come close to or separate away from the first guide;

the side gate is opened and closed to rotate about a supporting point disposed at an upper side and a lower side of a side wall of the apparatus main body, and an adhesive agent is adhered to a divided guide or adjustment guide separated away from the supporting point.

* * * * *